US010094133B2

(12) United States Patent
Hong Ting

(10) Patent No.: US 10,094,133 B2
(45) Date of Patent: Oct. 9, 2018

(54) PANEL ASSEMBLY

(71) Applicant: AJA Enterprises Pte Ltd., Singapore (SG)

(72) Inventor: Toh Hong Ting, Singapore (SG)

(73) Assignee: AJA Enterprises PTE LTD., Singapore (SG)

( * ) Notice: Subject to any disclaimer, the term of this patent is extended or adjusted under 35 U.S.C. 154(b) by 0 days.

(21) Appl. No.: 15/101,402

(22) PCT Filed: Nov. 28, 2014

(86) PCT No.: PCT/SG2014/000566
§ 371 (c)(1),
(2) Date: Jun. 2, 2016

(87) PCT Pub. No.: WO2015/084261
PCT Pub. Date: Jun. 11, 2015

(65) Prior Publication Data

US 2016/0369519 A1 Dec. 22, 2016

(30) Foreign Application Priority Data

Dec. 3, 2013 (SG) ..... 2013089586

(51) Int. Cl.
*E04H 9/04* (2006.01)
*E06B 5/12* (2006.01)
(Continued)

(52) U.S. Cl.
CPC ..... *E04H 9/04* (2013.01); *E04B 2/88* (2013.01); *E04C 2/40* (2013.01); *E04C 2/46* (2013.01);
(Continued)

(58) Field of Classification Search
CPC ..... E04B 2/88; E04C 2/40; E04C 2/46; E04C 2/526; E04H 9/04; E04H 9/06; E06B 1/60; E06B 5/12
See application file for complete search history.

(56) References Cited

U.S. PATENT DOCUMENTS 2,988,786 A * 6/1961 Roos ..... E06B 1/02 49/465
3,712,482 A * 1/1973 Bondowski ..... B66C 1/18 294/74
(Continued)

FOREIGN PATENT DOCUMENTS

DE 2747285 A1 4/1979
DE 20307778 U1 10/2003
(Continued)

OTHER PUBLICATIONS

International Search Report and Written Opinion dated Jan. 19, 2015, for PCT/SG2014/000566 (9 pages).
(Continued)

*Primary Examiner* — James M Ference
(74) *Attorney, Agent, or Firm* — Patent Law Works LLP

(57) ABSTRACT

The present invention relates to a panel assembly adapted to absorb a blast effect. The panel assembly includes a panel adapted to be displaceably mounted to a frame, an extendable connecting assembly extending from the panel and adapted to be connectable to the frame so as to mount the panel to the frame, the extendable connecting assembly is adapted to extend in a longitudinal direction and in a controlled manner, such that the extendable connecting assembly includes, a controlling portion connected to the panel, and a connecting portion adapted to be connectable to the frame, the connecting portion glidably coupled to the controlling portion, such that the controlling portion is adapted to control the extension of the connecting portion
(Continued)

from the controlling portion, such that the extendable connecting assembly is adapted to extend in a controlled manner to control the movement of the panel when receiving the blast effect.

19 Claims, 16 Drawing Sheets

(51) Int. Cl.

| | |
|---|---|
| ***E04H 9/06*** | (2006.01) |
| ***E04B 2/88*** | (2006.01) |
| ***E04C 2/40*** | (2006.01) |
| ***E04B 2/00*** | (2006.01) |
| ***E04C 2/52*** | (2006.01) |
| ***F41H 5/00*** | (2006.01) |
| ***F42D 5/045*** | (2006.01) |
| ***F41H 5/013*** | (2006.01) |
| *E06B 1/60* | (2006.01) |

(52) U.S. Cl.
CPC ..... *E04C 2/526* (2013.01); *E04H 9/06* (2013.01); *E06B 5/12* (2013.01); *F41H 5/00* (2013.01); *F41H 5/013* (2013.01); *F42D 5/045* (2013.01); *E06B 1/60* (2013.01)

(56) References Cited

U.S. PATENT DOCUMENTS 4,103,948 A * 8/1978 Naka ..... E04B 9/003 292/256
4,428,152 A * 1/1984 Gubri ..... E06B 3/01 49/131
4,625,659 A * 12/1986 Saelzer ..... E06B 3/2605 109/49.5
4,630,411 A * 12/1986 Salzer ..... E06B 3/2605 109/27
4,718,356 A * 1/1988 Caspe ..... E04B 1/92 109/27
4,748,790 A * 6/1988 Frangolacci ..... E04B 1/98 109/49.5
4,766,708 A * 8/1988 Sing ..... E04B 1/98 248/585
5,072,554 A 12/1991 Hayman
5,553,422 A * 9/1996 Gazaway ..... E06B 5/10 52/204.53
5,934,020 A * 8/1999 McCracken ..... E06B 9/04 160/222
6,298,766 B1 * 10/2001 Mor ..... E04H 9/06 52/203
6,333,085 B1 * 12/2001 Emek ..... E06B 3/2605 428/34
6,363,669 B1 * 4/2002 Hoffman ..... E06B 1/6015 52/202
6,367,210 B1 * 4/2002 Trundle ..... E06B 5/10 52/204.5
6,502,356 B2 * 1/2003 Emek ..... E06B 1/6046 49/322
6,581,342 B1 * 6/2003 Tavivian ..... B32B 17/10 156/106
6,931,799 B2 * 8/2005 Webb ..... E06B 5/10 156/71
7,040,062 B2 * 5/2006 Emek ..... E06B 1/02 52/203
7,775,003 B2 * 8/2010 Sabac ..... G03B 17/26 52/204.53
7,975,432 B2 * 7/2011 Morton ..... E05B 3/0008 49/246
8,424,473 B1 * 4/2013 Mandall ..... F41H 5/226 109/26
2003/0208970 A1 * 11/2003 Saelzer ..... E06B 1/6084 52/167.1
2004/0226231 A1 * 11/2004 Dlubak ..... B32B 17/10036 52/204.1
2005/0102933 A1 * 5/2005 Salzer ..... E05D 15/52 52/204.5
2005/0144900 A1 * 7/2005 Hallissy ..... E04B 1/98 52/782.1
2006/0032160 A1 * 2/2006 Gazaway ..... E06B 5/12 52/202
2006/0112641 A1 * 6/2006 Salzer ..... E06B 5/12 49/67
2007/0011962 A1 * 1/2007 Erskine ..... B32B 17/10036 52/204.71
2007/0180982 A1 * 8/2007 Dagher ..... F41H 5/013 89/36.02
2007/0245887 A1 * 10/2007 James ..... E04H 9/10 89/36.01
2008/0178540 A1 * 7/2008 Salzer ..... E06B 3/26303 52/202
2009/0255448 A1 * 10/2009 Loomis ..... E04C 2/546 109/58
2010/0024692 A1 * 2/2010 Bar ..... B32B 17/10045 109/64
2010/0307386 A1 * 12/2010 Stockhausen ..... E04B 2/96 109/79
2011/0192328 A1 * 8/2011 Frest ..... E04H 9/06 109/76
2012/0085223 A1 * 4/2012 Kennedy ..... E06B 5/12 89/36.02
2012/0159881 A1 * 6/2012 White ..... E06B 5/106 52/208
2013/0000205 A1 * 1/2013 Raz ..... E05B 17/0025 49/366
2013/0202874 A1 * 8/2013 Miller ..... B62D 25/20 428/316.6
2016/0369519 A1 * 12/2016 Hong Ting ..... E06B 5/12

FOREIGN PATENT DOCUMENTS

| | | | |
|---|---|---|---|
| JP | 2012180992 | A | 9/2012 |
| WO | 2004072425 | A1 | 8/2004 |
| WO | 2008062410 | A2 | 5/2008 |

OTHER PUBLICATIONS

Notification of Transmittal of International Preliminary Report on Patentability dated Oct. 21, 2015, for PCT/SG2014/000566 (5 pages).
BlastWrap—BlastGard International Inc., download on Sep. 12, 2016, from www.blastgardintl.com/blastwrap/ (5 pages).
Radiantech Engineering Pte Ltd., download on Sep. 12, 2016, from www.radiantech.com.sg/products.html (2 pages).
Blast Resistant Doors, download on Sep. 12, 2016, from www.tacamsteel.com/Products/BlastResistant.html (1 page).
Blast Mitigation Products, Blast Resistant Products List, download on Sep. 12, 2016, from www.kawneer.com/kawneer/north_america/catalog/pdf/booklets/Open_Air_Arena_Blast_Test.pdf (1 page).
Blast Mitigating Products, Windows, Walls and Curtain Walls, download on Sep. 12, 2016, from www.Kawneer.com/kawneer/north_america/en/product_category.asp?cat_id=1669 (3 pages).
Arpal Defender Safety thats build in—Blast Mitigation, download on Sep. 12, 2016, from www.arpal.com/blast.asp (1 page).
Blast Resistant Doors and Walls, BFJ Global Trade, download on Sep. 12, 2016, from www.bfj-global.com (1 page).
Durasteel by Intumex Asia Pacific, Durasteel Fire Protection Systems, download on Sep. 12, 2016, from www.durasteel-ap.com (1 page).
Forced Protection, Fibre Reinforced Polymer, download on Sep. 12, 2016, from www.fibrwrapconstruction.com/force-protection-main.html (1 page).
Graham Blast & Ballistic-Resistant Windows and Doors, Graham Architectural Products, download on Sep. 12, 2016, form www.grahamwindows.com/blast/blast.html (4 pages).
Windows and Curtain Walls, Wausau Window, download on Sep. 12, 2016, from www.wausauwindow.com/support/index.cfm?page=blasthazard (1 page).

(56) References Cited

OTHER PUBLICATIONS

European Search Report for Supplementary European Search Report No. 14868185, dated Aug. 31, 2017, 6 pages.

* cited by examiner

107

108

PANEL ASSEMBLY

CROSS REFERENCE TO RELATED APPLICATIONS

This application is a National Stage of International Application No. PCT/SG2014/000566 filed Nov. 28, 2014, entitled "A PANEL ASSEMBLY", which claims priority to Singaporean Application 2013089586 filed Dec. 3, 2013, all of which are hereby incorporated by reference in their entirety.

TECHNICAL FIELD

The present invention relates to a panel assembly, for example, a panel assembly for a building or the facade of the building.

BACKGROUND

More and more modern buildings built in the recent decades use panels to cover the exterior of the buildings as they provide a contemporary look to the buildings. In addition, the use of panels may increase the speed in completing the buildings. Panels may be made of materials like metal, glass etc.

However, buildings of such designs may be susceptible to explosive forces and the panels may be damaged and even cause injury to occupants of the buildings. A glass panel may shatter under the impact of the explosive force and shards or broken fragments of the glass panel may damage property and/or injure or kill people near the glass panel. In recent history, there have been many instances where the explosion is intentionally set off to inflict harm to innocent people, e.g. bomb blast.

With development in technology, the intensity of such explosive force is increasing. A building and its facade may be subjected to an increasing amount of explosive effect. Typically, to counter the higher explosive blast intensity, the blast load capacity of the structure has to be increased. However, practical limitations of the building structure exists and thereby limits the capacity of the building to absorb the higher blast load.

There have been many devices designed to absorb the explosive effects onto the panels of a building. However, many of such devices are bulky and difficult to install. As such, panels with such devices may affect the facade of the building. Difficulty in the installation of the panels may result in the use of large equipment for the installation of the devices and panels onto the buildings.

Further, each of these devices do not cater to the range of blast load that can be absorbed by the devices. Usually, to cater to different level of explosive load, a plurality of devices each having different blast load capacity has to be made. As such, it is costly to fabricate and store the plurality of devices.

The present invention aims to overcome or reduce the problems as described above.

SUMMARY

According to various embodiments, a panel assembly adapted to absorb a blast effect is provided. The panel assembly includes a panel adapted to be displaceably mounted to a frame, an extendable connecting assembly extending from the panel and adapted to be connectable to the frame so as to mount the panel to the frame, the extendable connecting assembly is adapted to extend in a longitudinal direction and in a controlled manner, such that the extendable connecting assembly includes, a controlling portion connected to the panel, and a connecting portion adapted to be connectable to the frame, the connecting portion glidably coupled to the controlling portion, such that the controlling portion is adapted to control the extension of the connecting portion from the controlling portion, such that the extendable connecting assembly is adapted to extend in a controlled manner to control the movement of the panel when receiving the blast effect.

According to various embodiments, the controlling portion may include a clamp adapted to clamp the connecting portion to restrain the movement of the connecting portion within the controlling portion.

According to various embodiments, the clamp may include a first plate having an upper engaging surface and a second plate having a lower engaging surface, the upper engaging surface of the first plate may be adapted to face the lower engaging surface of the second plate, the connecting portion may be clamped between the first plate and the second plate.

According to various embodiments, the first plate may include a gripping portion on the upper engaging surface, the gripping portion may be adapted to grip the connecting portion.

According to various embodiments, the gripping portion of the first plate may include a groove extending along the upper engaging surface of the first plate and the connecting portion may be disposed within the groove of the first plate.

According to various embodiments, the second plate may include a gripping portion on the lower engaging surface of the second plate, the gripping portion may be adapted to grip the connecting portion.

According to various embodiments, the gripping portion of the second plate may include a groove extending along the lower engaging surface of the second plate and such that the connecting portion may be disposed within the groove of the second plate.

According to various embodiments, the connecting portion may extend through the controlling portion.

According to various embodiments, the extendable connecting assembly may extend from one side of the panel.

According to various embodiments, the panel assembly may include another extendable connecting assembly extending from another side of the panel opposite the one side.

According to various embodiments, the panel assembly may include at least two extendable connecting assemblies extending from one side of the panel and at least two extendable connecting assemblies extending from another side of the panel opposite the one side.

According to various embodiments, the connecting portions of the at least two extendable connecting assemblies are connected to each other such that the connecting portions form a single continuous connecting portion and extend through the controlling portions of the at least two extendable connecting assemblies.

According to various embodiments, the panel assembly may further include another extendable connecting assembly extending from the panel and disposed between the at least two extendable connecting assemblies, such that the connecting portions of each of the at least two extendable connecting assemblies and the another extendable connecting assembly form a single continuous connecting portion through each of the controlling portions of the at least two extendable connecting assemblies and the another extendable connecting assemblies.

According to various embodiments, the extendable connecting assembly may further include, a third plate having a lower engaging surface facing an upper engaging surface of the second plate, such that the upper engaging surface of the second plate may be opposite of the lower engaging surface of the second plate; and another connecting portion clamped between the second plate and the third plate, and between the upper engaging surface of the second plate and the lower engaging surface of the third plate.

According to various embodiments, the connecting portion may include a cable.

According to various embodiments, the connecting portion may include an enlarged end at an end of the connecting portion.

According to various embodiments, the extendable connecting assembly may include an engaging end adapted to engage the frame.

According to various embodiments, the panel assembly may further include a base plate adapted to engage the extendable connecting assembly, the base plate being mountable to the frame.

According to various embodiments, the base plate may include a receiving portion adapted to receive the engaging end of the extendable connecting assembly when mounting the panel assembly to the frame.

According to various embodiments, the engaging end may include a knob and the receiving portion may include a slot having a width and an opening connected to the slot, the opening being wider than the width of the slot, such that the opening may be adapted to receive the knob therethrough and the slot may be adapted to prevent the knob therethrough.

DETAILED DESCRIPTION

Figure 1:
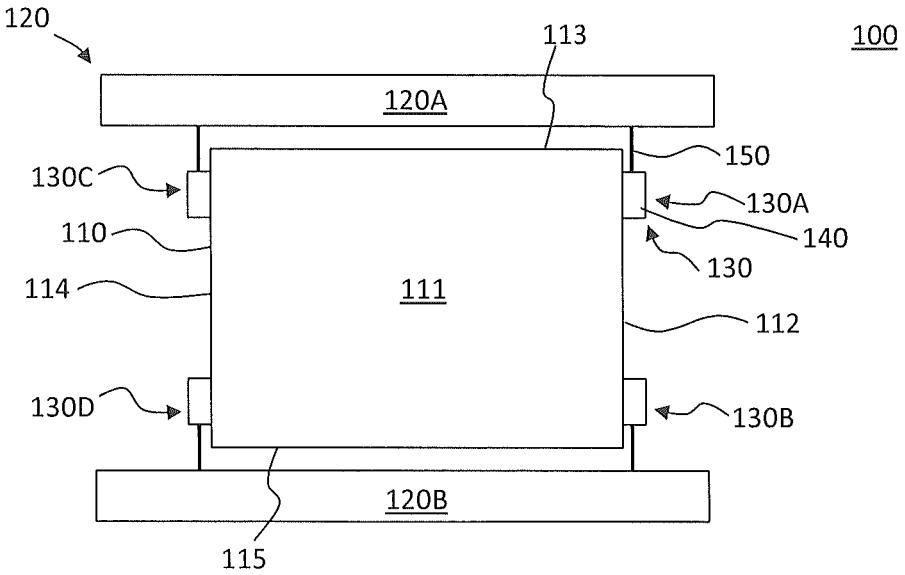
FIG. 1 shows a schematic view of a panel assembly.

FIG. 1 shows an exemplary embodiment of a panel assembly 100 adapted to absorb a blast effect. Panel assembly 100 has a panel 110 adapted to be displaceably mounted to a frame 120. Panel assembly 100 has an extendable connecting assembly 130 extending from the panel 110 and adapted to be connectable to the frame 120 so as to mount the panel 110 to the frame 120. Extendable connecting assembly 130 is adapted to extend in a longitudinal direction and in a controlled manner. Extendable connecting assembly 130 has a controlling portion 140 connected to the panel 110, and a connecting portion 150 adapted to be connectable to the frame 120. Connecting portion 150 is glidably coupled to the controlling portion 140 such that the controlling portion 140 is adapted to control the extension of the connecting portion 150 from the controlling portion 140 so that the extendable connecting assembly 130 is adapted to extend in a controlled manner to control the movement of the panel 110 when receiving the blast effect. Panel assembly 100 may be an energy absorbing system adapted to absorb the blast effect.

As shown in FIG. 1, the panel assembly 100 may include a panel 110 having at least one extendable connecting assembly 130A connected to the panel 110.

Panel 110 may have a front side 111 and a rear side (not shown in FIG. 1) opposite the front side. Front side may be a side of the panel 110 which faces outside of a building when the panel 110 is installed onto the building. Correspondingly, the rear side of the panel 110 may be a side facing the inside of the building. Panel 110 may include a top side 113, a bottom side 115 opposite the top side 113.

Extendable connecting assembly 130 may have a controlling portion 140 and a connecting portion 150 coupled to and extending from the controlling portion 140. Connecting portion 150 may be adapted to be connected to the frame 120. Panel 110 may be mounted to the frame 120 and may be displaceable or movable with respect to the frame 120 due to the extension of extendable connecting assembly 130. Extendable connecting assembly 130 may be connected to one side 112 of the panel 110. Panel assembly 100 may include at least two extendable connecting assemblies 130A, 130C such that panel assembly 100 may have another extendable connecting assembly 130C extending from another side 114 of the panel 110 opposite the one side 112. Extendable connecting assembly 130A may extend in a direction parallel to the front side of the panel 110. Another extendable connecting assembly 130C may extend in the direction parallel to the front side of the panel 110. Extendable connecting assembly 130 may be an energy absorbing device. When receiving a initial blast effect, the panel 110 may receive the blast energy and the connecting portion 150 may be pulled and extended from within the controlling portion 140 until the blast energy is dissipated from the system. In this way, the panel assembly is able to absorb the blast energy without being blown away or into pieces. Therefore, damages to property and lives can be avoided or minimised.

Referring to FIG. 1, the panel assembly 100 may have at least two extendable connecting assemblies 130A,130B extending from one side 112 of the panel 110 and at least two extendable connecting assemblies 130C,130D extending from another side 114 of the panel 110 opposite the one side 112.

Frame 120 may include an upper portion 120A and a lower portion 120B spaced from the upper portion 120A. Upper portion 120A may be spaced from the lower portion 120B in a vertical direction. Upper portion 120A and the lower portion 120B may extend in a horizontal direction which is substantially perpendicular to the vertical direction.

Panel 110 may be disposed within the frame 120. Panel 110 may be disposed between the upper portion 120A and the lower portion 120B. Frame 120 may be mounted to a portion of the building. Frame 120 may be part of the building. Top side 113 of the panel 110 may be the side facing the upper portion 120A. Bottom side 115 of the panel may be the side facing the lower portion 120B.

Usually, an explosion occurs from outside of the building, i.e. against the front side of the panel 110. Consequently, the panel 110 may be forced to be displaced in an inward direction into the building. Inward direction may be a direction perpendicular to the vertical direction and horizontal direction.

As shown in FIG. 1, the panel assembly may include four extendable connecting assemblies 130A,130B,130C,130D. Extendable connecting assemblies 130A,130B may be disposed along the one side of the panel 110 and the extendable connecting assemblies 130C,130D may be disposed along the another side of the panel 110. Extendable connecting assemblies may extend in the vertical direction which is from the upper portion 120A to the lower portion 120B of the frame 120. As shown in FIG. 1, the extendable connecting assemblies 130A,130C may be directed towards the upper portion 120A of the frame 120, i.e. in an upwards direction, and extendable connecting assemblies 130B,130D may be directed towards the lower portion 120B, i.e. in a downward direction. Extendable connecting assembly 130 is directed towards the frame 120 when the connecting portion 150 of the extendable connecting assembly 130 extends from the controlling portion 140 towards the frame 120. Extendable connecting assemblies 130A,130B,130C,130D may be attached to the frame 120 so as to mount the panel 110 to the frame 120. Panel 110 may be spaced from the upper portion 120A and/or the lower portion 120B. Panel 110 may be resting on lower portion 120B.

Figure 2:
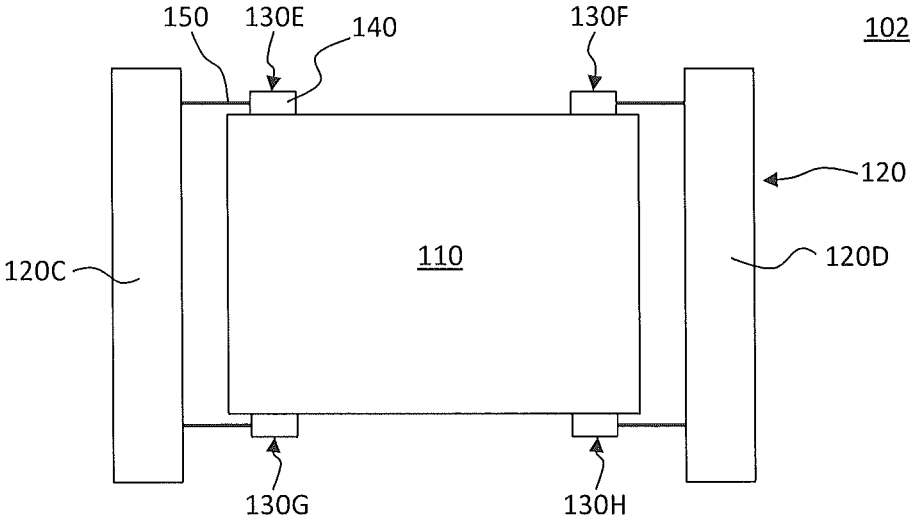
FIG. 2 shows a schematic view of a panel assembly.

FIG. 2 shows another exemplary embodiment of the panel assembly 102. Frame 120 may include a first side portion 120C and a second side portion 120D spaced from the first side portion 120D. First side portion 120C and the second side portion 120D may be arranged to extend in the vertical direction. Panel 110 may be disposed between the first side portion 120C and the second side portion 120D. Similar to the earlier embodiment, the extendable connecting assemblies 130A,130B,130C,130D may be attached to the frame 120 so as to mount the panel 110 to the frame 120.

Referring to FIG. 2, the extendable connecting assemblies 130E,130F,130G,130H may extend in a horizontal direction. Extendable connecting assemblies 130E,130G may be directed towards the first side portion 120C. Extendable connecting assemblies 130F,130H may be directed towards the second side portion 120D. Panel 110 may be spaced from the first side portion 120C and/or the second side portion 120D.

Extendable connecting assembly 130 may be disposed between the panel 110 and the frame 120. Extendable connecting assembly 130 may be extended from the panel 110 to the frame 120.

Figure 3:
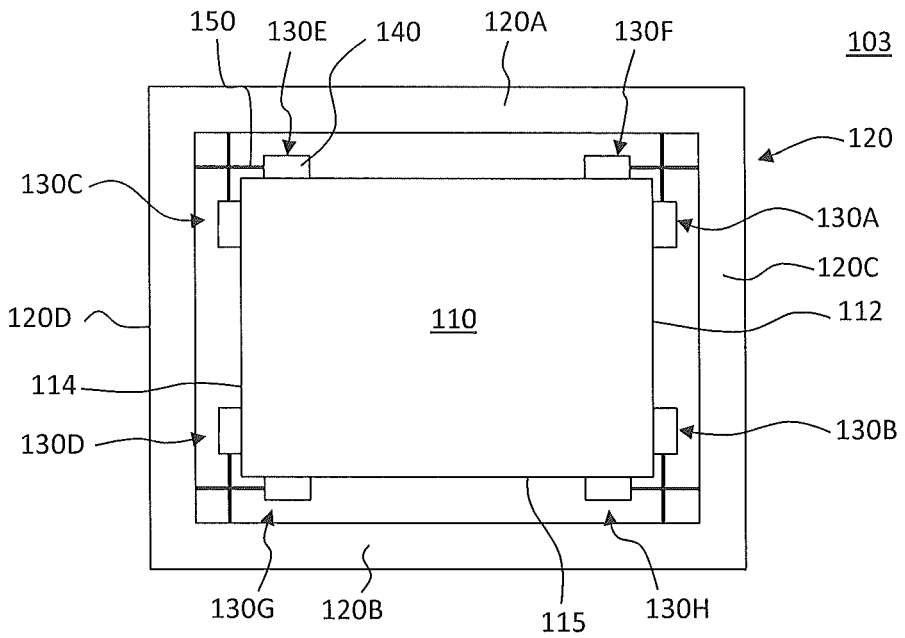
FIG. 3 shows a schematic view of a panel assembly.

FIG. 3 shows an exemplary embodiment of the panel assembly 103. Frame 120 may be a rectangular frame. Frame 120 may include the upper portion 120A and the lower portion 120B and the first side portion 120C and second side portion 120D such that the upper portion 120A and lower portion 120B may be substantially perpendicular to the first side portion 120C and the second side portion 120D. Frame 120 may surround the panel 110. Panel assembly 103 may include at least two extendable connecting assemblies 130 along each side of the panel 110. For example, the one side 112 of panel 110 may include at least two extendable connecting assemblies 130A,130B. Panel assembly 103 may include at least eight extendable connecting assemblies 130A,130B,130C,130D,130E,130F,130G,130H attached to the frame 120. Corresponding, extendable connecting assemblies 130C,130D may be along the another side 114, extendable connecting assemblies 130E,130F may be along a top side 113 of the panel 110 and extendable connecting assemblies 130G,130H may be along a bottom side 115 of the panel 110.

Figure 4A:
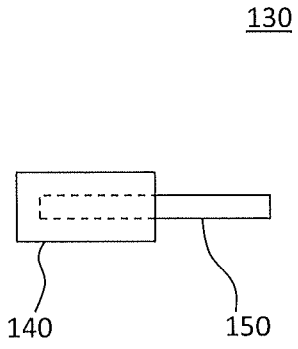
FIG. 4A shows a schematic view of an extendable connecting assembly in an installed configuration.

FIG. 4A shows an exemplary embodiment of the extendable connecting assembly 130 in the installed position. As shown FIG. 4C, in the installed position, the connecting portion 150 has yet to be extended from the controlling portion 140. Extendable connecting assembly 130 may be in the installed position when the panel assembly 100 is mounted to the frame 120. As mentioned, extendable connecting assembly 130 may include a controlling portion 140 adapted to control the extension of the connecting portion 150 from the controlling portion 140 and a connecting portion 150 coupled to the controlling portion 140. Connecting portion 150 may extend from within the controlling portion 140 into a extended position (refer to FIG. 4B). Connecting portion 150 may be adapted to be connected to the frame 120. Extendable connecting assembly 130 may be adapted to connect the panel 110 to the frame 120.

Figure 4B:
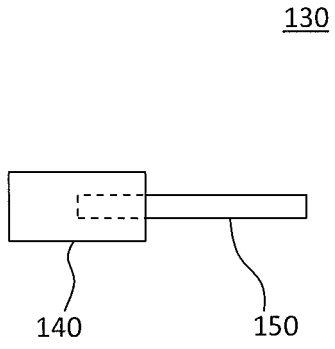
FIG. 4B shows a schematic view of an extendable connecting assembly in an extended configuration.
Figure 4C:
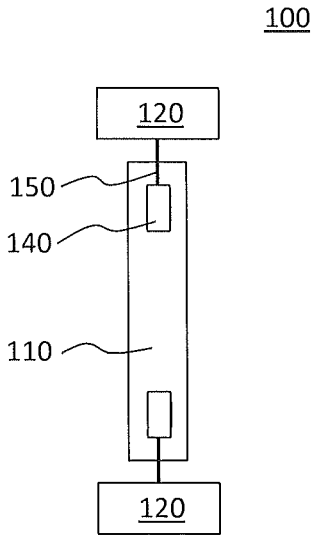
FIG. 4C shows a side view of a panel assembly in an installed position.
Figure 4D:
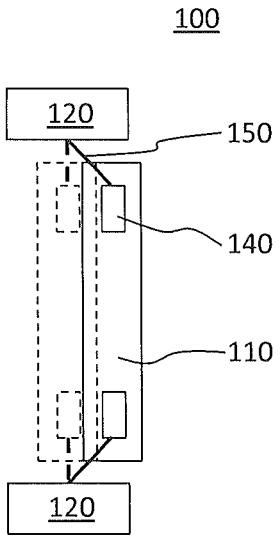
FIG. 4D shows a side view of the panel assembly in FIG. 4C in a displaced position.

FIG. 4B shows the connecting portion 150 of the extendable connecting assembly 130 in an extended position. FIG. 4D shows the connecting portion 150 may be extended from the controlling portion 140 when the panel 110 of the panel assembly 100 has been subject to an explosive effect and may be displaced in a direction away from the source of the explosive effect. Controlling portion 140 may be adapted to control the movement or extension of the connecting portion 150 from the initial position (as shown in broken lines). Connecting portion 150 when extended may be inclinded towards the point of engagement of the connecting portion 150 to the frame 120.

Figure 5:
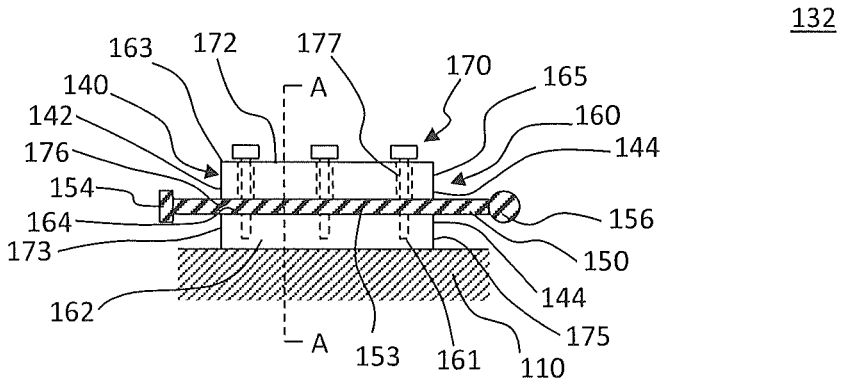
FIG. 5 shows a sectional view of an extendable connecting assembly.

FIG. 5 shows an exemplary embodiment of extendable connecting assembly 132. Controlling portion 140 may include a clamp 160 adapted to clamp the connecting portion 150 to control the movement of the connecting portion 150 within the controlling portion 140.

Referring to FIG. 5, the clamp 160 may include a first plate 162 having an upper engaging surface 164 and a second plate 172 having a lower engaging surface 176. Upper engaging surface 164 of the first plate 162 may be adapted to face the lower engaging surface 176 of the second plate 172. Connecting portion 150 may be clamped between the first plate 162 and the second plate 172. First plate 162 may be spaced from the second plate 172 when clamp 160 clamps the connecting portion 150. First plate 162 may be substantially parallel to the second plate 172. First plate 162 may be connected to the panel 110. First plate 162 may include a proximal end 163 and a distal end 165 opposite the proximal end 163. Second plate 172 may include a proximal end 173 and a distal end 175 opposite the proximal end 173.

Figure 6:
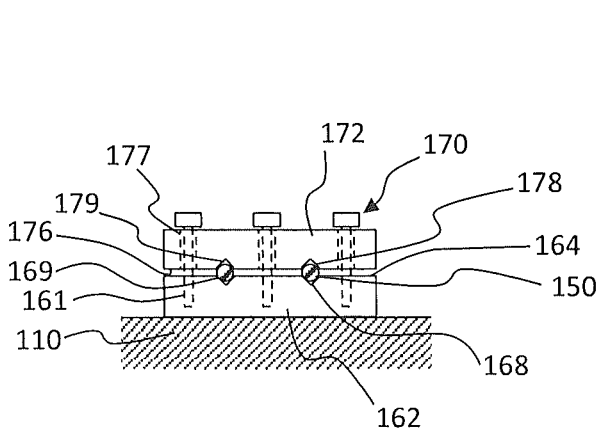
FIG. 6 shows a sectional view of the extendable connecting assembly in FIG. 5 along line A-A.

FIG. 6 shows a sectional view of the extendable connecting assembly 132 along line A-A in FIG. 5. As shown in FIG. 6, the first plate 162 may include a gripping portion 168 on the upper engaging surface 164. Gripping portion 168 may be adapted to grip the connecting portion 150. Gripping portion 168 may extend from the proximal end 163 (not shown in FIG. 6) of the first plate 162 to the distal end 165 (not shown in FIG. 6). Gripping portion 168 may be a recess on the upper engaging surface 164 of the first plate 162. Gripping portion 168 of the first plate 162 may include a groove 169 extending along the upper engaging surface 164 of the first plate 162. As shown in FIG. 6, the groove 169 may include a V-shape cross-section. Groove 169 may include a semi-circular, rectangular cross-section. Gripping portion 168 may include ribs (not shown in FIG. 6) arranged along the upper engaging surface 164. As shown in FIG. 6, the connecting portion 150 may be disposed within the groove 169 of the first plate 162. Connecting portion 150 may be recessed into the groove 169.

Gripping portion 168 may be adapted to increase the area of contact between the first plate 162 and the connecting portion 150 so as to increase the friction between the first plate 162 and connecting portion 150. Gripping portion 168 may extend along the connecting portion 150 to provide an appropriate amount of gripping force on the connecting portion 150.

Referring to FIG. 6, the second plate 172 may include a gripping portion 178 on the lower engaging surface 176 of the second plate 172. Gripping portion 178 may be adapted to grip the connecting portion 150. Gripping portion 178 may extend from the proximal end 173 to the distal end 175 Gripping portion 178 may be a recess on the lower engaging surface 176 of the second plate 172. Gripping portion 178 of the second plate 172 may include a groove 179 extending along the lower engaging surface 176 of the second plate 172. As shown in FIG. 6, the groove 179 may have a V-shape cross-section. Groove 179 may include a semi-circular, rectangular cross-section. Gripping portion 178 may include ribs (not shown in FIG. 6) arranged along the lower engaging surface 176. As shown in FIG. 6, the connecting portion 150 may be disposed within the groove 179 of the second plate 172. Connecting portion 150 may be recessed into the groove 179.

Gripping portion 178 may be adapted to increase the area of contact between the second plate 172 and the connecting portion 150 so as to increase the friction between the second plate 172 and connecting portion 150. Gripping portion 178 may extend along the connecting portion 150 to provide an appropriate amount of gripping force on the connecting portion 150. Gripping portion 178 of the second plate 172 may be directly opposite the gripping portion 168 of the first plate 162.

Referring to FIG. 5, the controlling portion 140 may include a fastening member 170 adapted to fasten the second plate 172 to the first plate 162. Fastening member 170 may be a bolt adapted to fasten the second plate 172 to the first plate 162. Second plate 172 may include through holes 177 adapted to allow fastening member 170 through the second plate 172. First plate 162 may include a socket 161 adapted to engage the fastening member 170. Fastening member 170 may be inserted through the through hole 177 and engage the socket 161 so as to fasten the first plate 162 to the second plate 172 to clamp the connecting portion 150. Fastening member 170 may be a screw, a bolt etc. Fastening member 170 may include a clip (not shown in FIG. 5) adapted to clip the first plate 162 and the second plate 172 together. Socket 161 may be a threaded hole and fastening member 170 may include a threaded end adapted to engage the threaded hole.

Referring to FIG. 5, the connecting portion 150 may have an elongated body 153 such that the connecting portion 150 may extend along the controlling portion 140.

Referring to FIG. 5, the connecting portion 150 of the extendable connecting assembly 130 may extend through the controlling portion 140. Controlling portion 140 may include an entry end 142 and an exit end 144 opposite the entry end 142. Entry end 142 may be an end where the connecting portion 150 retracts into the controlling and the exit end 144 may be an end where the connecting portion 150 extends out of the controlling portion 150. Entry end 142 of the controlling portion 140 may be the proximal end 163 of the first plate 162 and/or the proximal end 173 of the second plate 172. Exit end 144 may be the distal end 165 of the first plate 162 and/or the distal end 175 of the second plate 172.

Connecting portion 150 may have an enlarged end 154 adapted to be larger than a gap formed between the groove 169 of the first plate 162 and the groove 179 of the second plate 172 when the first plate 162 and the second plate 172 is fastened to clamp the connecting portion 150. Enlarged end 154 may be larger than the sectional area of the elongated body 153 of the connecting portion 150. Connecting portion 150 may have an engaging end 156 opposite the enlarged end 154. Connecting portion 150 may have a knob at the engaging end 156 of the connecting portion 150 such that the engaging end 156 may be adapted to engage the frame 120. As the extendable connecting assembly 130 may include the connecting portion 150, it is clear that the extendable connecting assembly 130 may have an engaging end 156 adapted to engage the frame 120.

With the engaging end 156 being connected to the frame 120, the connecting portion 150 may be displaced or glide through the controlling portion 140 in a displaced direction parallel to the first plate 162 and the second plate 172 such that the engaging end 156 may move away from the exit end 144 of the controlling portion 140 when the panel 110 is displaced due to an explosive effect. Accordingly, as the connecting portion 150 is displaced through the controlling portion 140, the enlarged end 154 of the connecting portion 140 may move towards the first end 142 of the controlling portion 140. It is foreseeable that it is possible that as the connecting portion 150 continues to move in the displaced direction, the enlarged end 154 of the connecting portion 150 may abut or contact the entry end 142 of the controlling portion 140 such that the displacement of the connecting portion 150 with respect to the controlling portion 140 may be terminated. It would be clear to the skilled person that due to the clamping of the connecting portion 150 by the controlling portion 140, the displacement of the connecting portion 150 may be decelerated in a controlled manner. As such, the displacement of the panel 110 due to the blast effect may be decelerated in a controlled manner. The length of the elongated body 153 of the connecting portion 140 between the enlarged end 154 of the connecting portion 150 and the entry end 142 of the controlling portion 150 may be pre-determined based on the extension of the connecting portion required which may be based on a calculated explosive effect and the pre-determined clamping force. As shown in FIG. 6, the first plate 162 may be connected to the panel 110.

Figure 7:
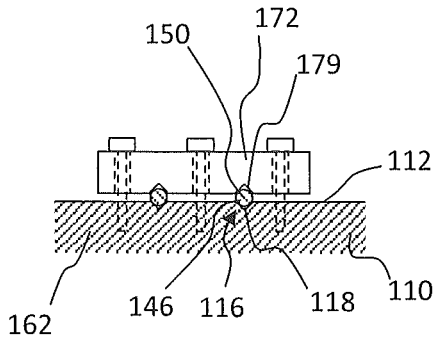
FIG. 7 shows a sectional view of the extendable connecting assembly.

FIG. 7 shows an exemplary embodiment of a panel assembly 107. First plate 162 may be integrally formed as part of the panel 110. As shown in FIG. 7, the panel 110 may have a gripping portion 116 formed along the one side 112 of the panel 110. One side 112 of the panel 110 may extend from the top side 113 (not shown in FIG. 7) to the bottom side 115 (not shown in FIG. 7) of the panel 110. Gripping portion 116 may be formed on the one side 112 of the panel 110. Gripping portion 116 may extend from about the top side 113 of the panel 110 to about the bottom side 115 of the panel 110. Gripping portion 116 may extend from the top side 113 of the panel 110 to the bottom side 115 of the panel 110. Gripping portion 116 may be a groove 118 extending along the one side 112 of the panel 110. As such, one side 112 of the panel 110 may be the first plate 162. Second plate 172 may be fastened onto the one side 112 of the panel 110. Connecting portion 150 may be clamped between the second plate 172 and the one side 112 of the panel 110. Connecting portion 150 may be recessed within the groove 118 along one side 112 of panel 110 and the groove 179 of the second plate 172. Similarly, the arrangement as described with respect to the one side 112 of panel 110 may be arranged on the another side 114 (not shown in FIG. 7) of the panel 110 such that the another side 114 is opposite the one side 112 of the panel 110.

Connecting portion 150 may include a flexible elongated member. Connecting portion 150 may be a cable 146. Connecting portion 150 may be made of a metallic material, e.g. stainless steel. Connecting portion 150 may include a plurality of flexible elongated members. Connecting portion 150 may include at least two cables. Connecting portion 150 may include three, four or five cables. Each flexible elongated member may be recessed within the groove 169 (not shown in FIG. 7) of the first plate 162 (not shown in FIG. 7) or the groove 118 of the one side 112 of the panel 110 and the groove 179 of the second plate 172.

Figure 8:
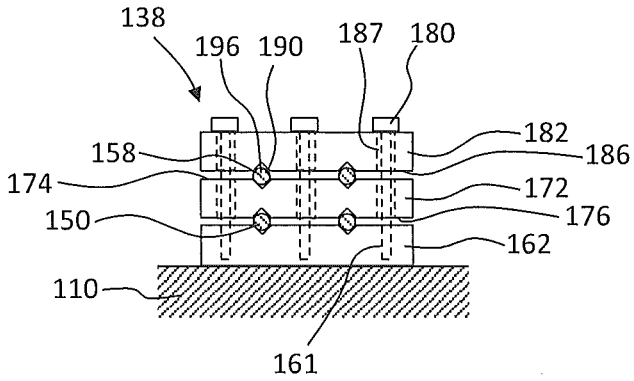
FIG. 8 shows a sectional view of the extendable connecting assembly.

FIG. 8 shows an exemplary embodiment of a panel assembly 108. Extendable connecting assembly 138 may include a third plate 182 having a lower engaging surface 186 facing an upper engaging surface 174 of the second plate 172. Upper engaging surface 174 of the second plate 172 may be opposite of the lower engaging surface 176 of the second plate 172. Extendable connecting assembly 138 may have another connecting portion 190 clamped between the second plate 172 and the third plate 182, between the upper engaging surface 174 of the second plate 172 and the lower engaging surface 186 of the third plate 182.

Extendable connecting assembly 138 may include a fastening member 180 adapted to fasten the first plate 162, the second plate 172 and the third plate together. Third plate 182 may include a through hole 187 for each fastening member 180 to go through. Third plate 182 may be placed onto the second plate 172. Another connecting portion 190 may be clamped between the second plate 172 and the third plate 182. Fastening member 180 may be inserted through the second plate 172 and third plate 182 and be fastened to the first plate 162. Fastening member 180 may be a bolt having a threaded end adapted to engage the socket 161 of the first plate 162. As mentioned above, first plate 162 may be integrally formed as one side of the panel 110.

Connecting portion 190 may include a flexible elongated member. Connecting portion 190 may be a cable 196. Connecting portion 190 may be made of a metallic material, e.g. stainless steel. Connecting portion 190 may include a plurality of flexible elongated members. Connecting portion 190 may include at least two cables. Connecting portion 190 may include three, four or five cables.

Extendable connecting assembly 138 may include a fourth plate, a fifth plate or as many plates as required. It would be clear to the skilled person that the extendable connecting assembly 138 may be configured to cater to the amount of blast load required by varying the number of plates and/or the number of cables.

Figure 9:
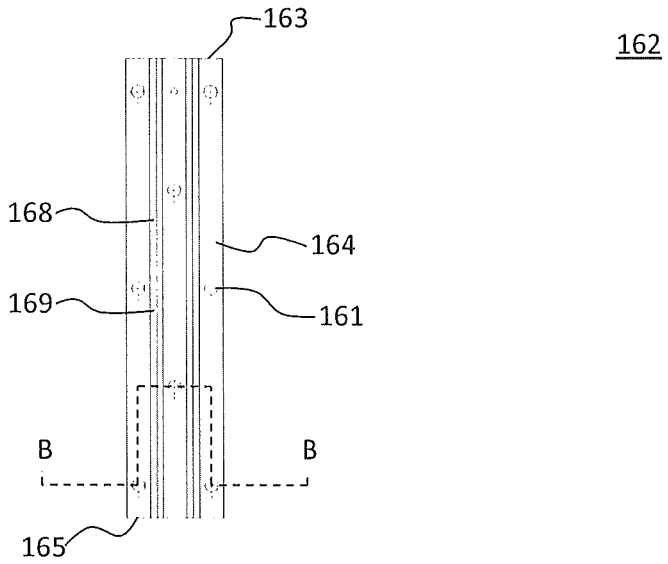
FIG. 9 shows a top view of a plate.

FIG. 9 shows a top view of an exemplary embodiment of a first plate 162. Second plate 172 (not shown in FIG. 8) and the third plate 182 (not shown in FIG. 8) may resemble the first plate 162 as shown in FIG. 9. Upper engaging surface 164 may extend from the proximal end 163 to the distal end 165 of the first plate 162. As shown in FIG. 9, the gripping portion 168 of the first plate 162 may extend from the proximal end 163 to the distal end 165 of the first plate 162. Gripping portion 168 may include at least one groove 169 extending along the upper engaging surface 164 from the proximal end 163 to the distal end 165 of the first plate 162. Gripping portion 168 may include a pair of grooves 169. First plate 162 may include a plurality of sockets 161 dispersed along the upper engaging surface 164 of the first plate 162 so as to enable the fastening member 170 (not shown in FIG. 8) to engage the plurality of sockets 161. For the second plate 172 (not shown in FIG. 8), the second plate 172 may include a plurality of through holes 177 adapted to allow the fastening member 170 to go through. The same is applicable to the third plate 182 and the plates thereafter.

As mentioned earlier, the first plate 162 may be formed integrally as part of the panel 110, the same gripping portion 168 may be formed on the one side 112 and/or the another side 114 of the panel 110.

Figure 10:
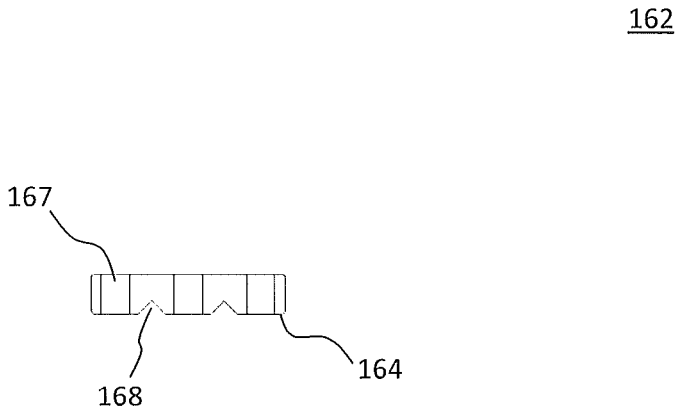
FIG. 10 shows a sectional view of the plate in FIG. 9 along line B-B.
Figure 11:
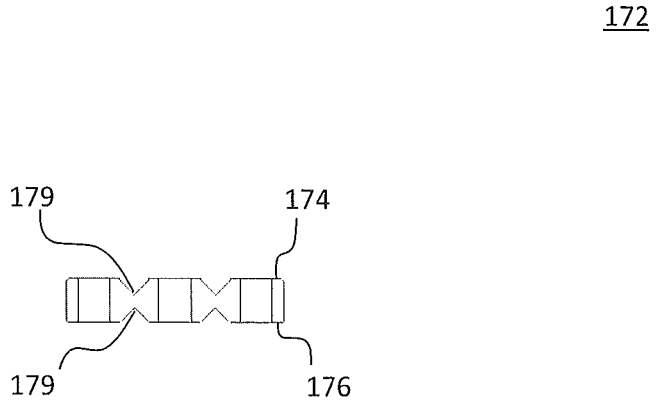
FIG. 11 shows a sectional view of a plate.

FIG. 10 shows a sectional view of the first plate 162 along line B-B. Although the first plate 162 as shown in FIG. 10 has gripping portion 168 along the upper engaging surface 164 of the first plate 162, it would be understood that a plate, e.g. the second plate 172, which is disposed between two plates would have the gripping portion along opposite engaging surfaces of the plate. For example, as shown in FIG. 11, the second plate 172 has groove 179 along the upper engaging surface 174 and the lower engaging surface 176 of the second plate 172. Understandably, the gripping portion 168 along the upper engaging surface as described above for the first plate 162 may be found along the engaging surfaces, upper and/or lower engaging surfaces, of each plate.

Figure 12:
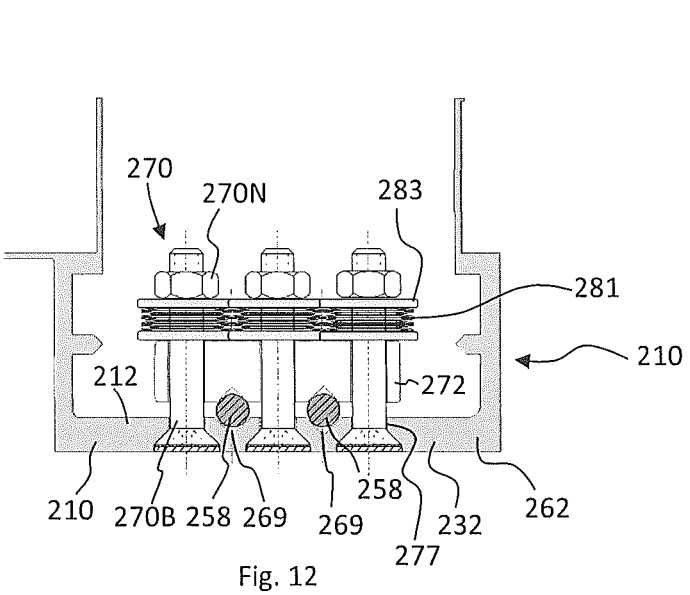
FIG. 12 shows a sectional view of an extendable connecting assembly.

FIG. 12 shows an exemplary embodiment of the extendable connecting assembly 230. First plate 232 of the extendable connecting assembly 230 may be integrally formed in the panel 210. Grooves 269 may extend along the one side 212 of the panel 210. Cable 258 may be clamped between the first plate 262 and the second plate 272. Extendable connecting assembly 230 may include a biasing member 281 adapted to bias the second plate 272 towards the first plate 262 and onto the cable 258. The installation of biasing member 281 provides a relatively constant clamping force on the cable 258. As shown in FIG. 12, the biasing member 281 may be forced onto the second plate 272 by the fastening member 270. Extendable connecting assembly 230 may include a pair of washers 283 adapted to sandwich the biasing member 281 and separate the biasing member 281 from the second plate 272. Fastening member 270 may be a bolt 270B and nut 270N configuration. Biasing member 281 may be a spring. Referring to FIG. 12, the bolt 270B may be inserted through the first plate 262. As such, the first plate 262 may include a plurality of through holes 277 for the bolt to go through.

Figure 13:
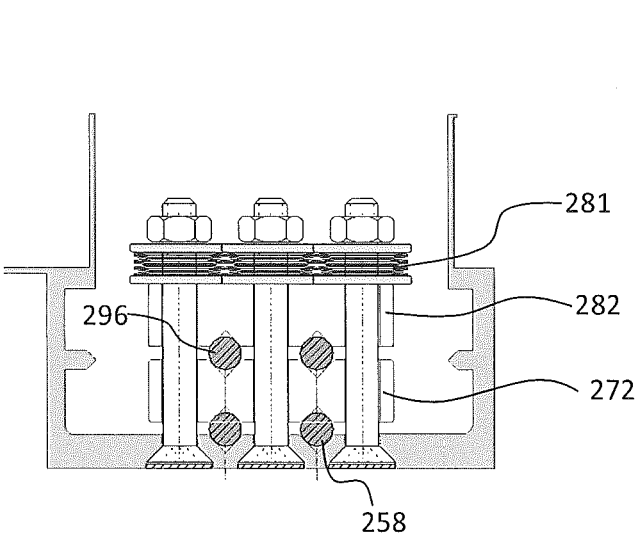
FIG. 13 shows a sectional view of an extendable connecting assembly.

FIG. 13 shows an exemplary embodiment of the extendable connecting assembly 232. Extendable connecting assembly 232 may include a third plate 282 disposed adjacent the second plate 272. Similar to the embodiment of the extendable connecting assembly 230 in FIG. 12, the third plate 282 may be biased against the second plate 272 by the biasing member 281. Cable 296 may be clamped between the second plate 272 and the third plate 282.

Figure 14:
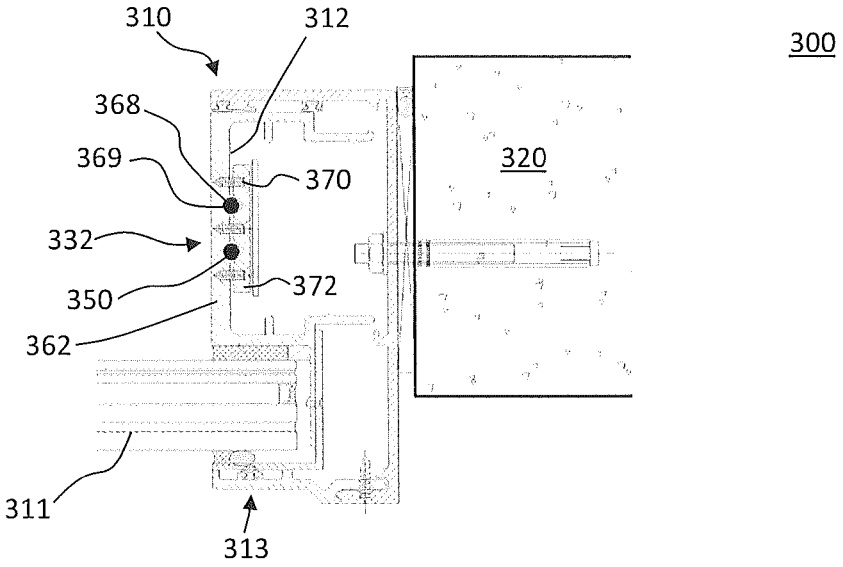
FIG. 14 shows a sectional view of a panel assembly.

FIG. 14 shows a sectional view of an exemplary embodiment of the panel assembly 300. Panel assembly 300 may include a panel 310 and an extendable connecting assembly 332 such that the first plate 362 is integrally formed as part of the panel 310. Panel 310 may include a window pane 311 and a window frame 313 surrounding the window pane 311. Extendable connecting assembly 332 may be connected to the window frame 313. As shown in FIG. 14, the extendable connecting assembly 332 may be disposed within the window frame 313 of the panel 310. Referring to FIG. 14, although the extendable connecting assembly 332 may be disposed on the window frame 313, it would be clear to a skilled person that the extendable connecting assembly 332 may be considered to be at about the one side of the panel 310. As such, the extendable connecting assembly 332, although disposed within the window frame 313, may be considered to be connected to the one side 312 and/or the another side 314 (not shown in FIG. 14) of the panel 310.

As shown in FIG. 14, the first plate 362 may be integrally formed with the window frame 313. First plate 362 may include gripping portion 368. Gripping portion 368 may include grooves 369 extending in the vertical direction along the window frame 313. Extendable connecting assembly 332 may include a connecting portion 350 extending along the longitudinal direction along the window frame 313. Extendable connecting assembly 332 may include a second plate 372 fastened to the first plate 362 to clamp connecting portion 350. Connecting portion 350 may be connectable to a frame 320 (not shown in FIG. 14) to displaceably mount the panel 310 to the frame 320. Second plate 372 may be fastened to the first plate 362 by fastening member 370. Second plate 372 may be biased towards the first plate 362 by biasing member 381 (not shown in FIG. 14) onto the second plate 372 using the fastening member 370. Panel assembly 300 as shown in FIG. 14 may be suitable for mounting of the panel assembly 300 to the frame 320. Frame 320 may be a building structure or part of the building structure.

Panel 310 may be an opaque panel or a transparent panel. Panel 310 may be made of metal, glass, etc. Panel 310 may be a window pane 311 having a window frame 313 surrounding the window pane 311 whereby the window pane 311 may be attached to the window frame 313.

Figure 15:
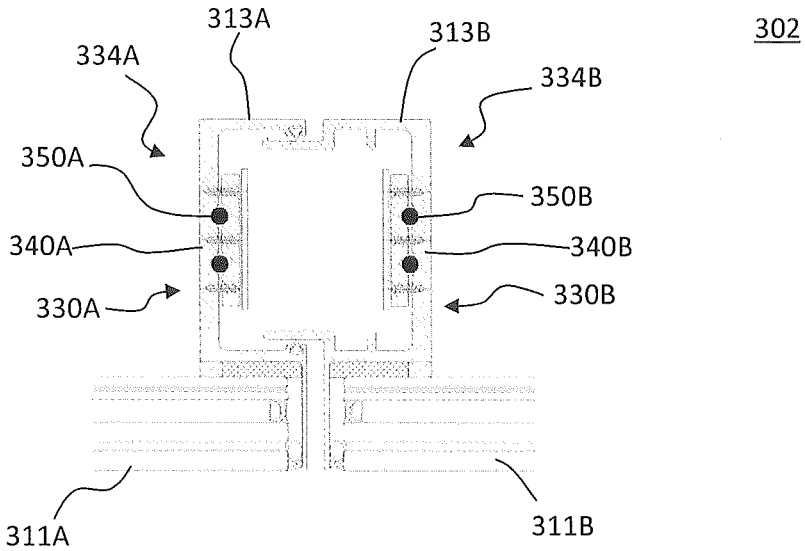
FIG. 15 shows a sectional view of a panel assembly.

FIG. 15 shows an exemplary embodiment of the panel assembly 302. FIG. 15 shows two panel assemblies 334A, 334B connected to each other. Respectively, the panel assembly 334A includes the window pane 311A connected to the window frame 313A and the panel assembly 334B includes the window pane 311B connected to the window frame 313B. Panel assemblies 334A,334B may be connected to each other at an interface between window frame 313A and window frame 313B. Extendable connecting assembly 330A may be disposed within window frame 313A wherein the connecting portion 350A may be extended from the controlling portion 340A to be connected to the frame 320 (not shown in FIG. 15). Similarly, the extendable connecting assembly 330B may be disposed within window frame 313B wherein the connecting portion 350B may be extended from the controlling portion 340B to be connected to the frame 320 (not shown in FIG. 15).

Figure 16:
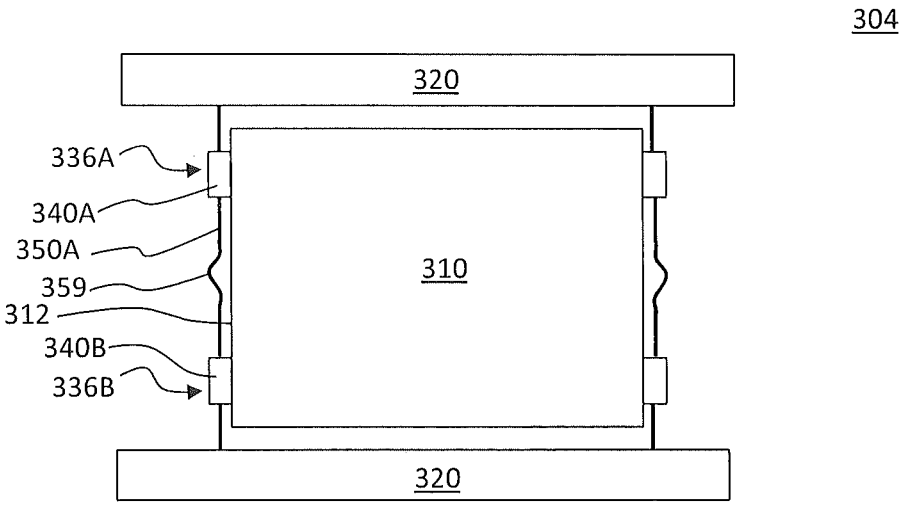
FIG. 16 shows a schematic view of a panel assembly.

FIG. 16 shows an exemplary embodiment of the panel assembly 304. As shown in FIG. 16, the panel 310 of the panel assembly 304 may include at least two extendable connecting assemblies 336A,336B along the one side 312 of the panel 310. As described, each of the at least two extendable connecting assemblies 336A,336B may include a controlling portion 340A,340B and a connecting portion 350A. Connecting portion 350B may be composed of connecting portions 350 of each of the at least two extendable connecting assemblies 336A,336B such that the connecting portions 350 of the two extendable connecting assemblies form a single continuous connecting portion 350B. Connecting portion 350B may extend through the controlling portions 340A,340B of the at least two extendable connecting assemblies 336A,336B. Referring to FIG. 16, the continuous connecting portion 350B may include a slack portion 359 between the at least two extendible connecting assembles 336A,336B. Slack portion 359 may allow the continuous connecting portion 350B to extend out of each or both of the at least two extendable connecting assemblies 336A,336B when the continuous connecting portion 350B straightens due to the displacement of the panel 310 when receiving an explosive effect.

Figure 17:
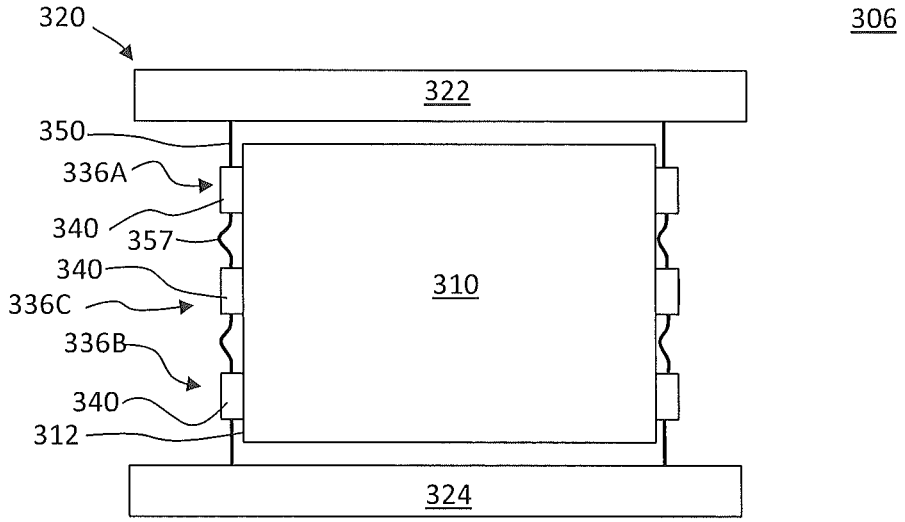
FIG. 17 shows a schematic view of a panel assembly.

FIG. 17 shows an exemplary embodiment of the panel assembly 306. Panel assembly 306 may include another extendable connecting assembly 336C extending from the panel 310 and disposed between the at least two extendable connecting assemblies 336A,336B such that the connecting portions 350 of each of the at least two extendable connecting 336A,336B assemblies and the another extendable connecting assembly 336C may form a single continuous connecting portion 357 through each of the controlling portions 340 of the at least two extendable connecting assemblies and the another extendable connecting assemblies 336C. Referring to FIG. 17, the panel assembly 306 may have at least three controlling portions 340 along the one side 312 of the panel 310. Connecting portion 357 may extend through the at least three controlling portions 340 such that the connecting portion 357 may have engaging ends opposite each other for attaching to opposite portions of the frame 320, e.g. upper portion 322 and lower portion 324.

Panel assembly 306 may include a spacer (not shown in FIG. 17) between the first plate 362 and the second plate 372 to provide a gap between the first plate 362 and the second plate 372. Spacer may be included in any of the embodiments of panel assemblies.

Figure 18:
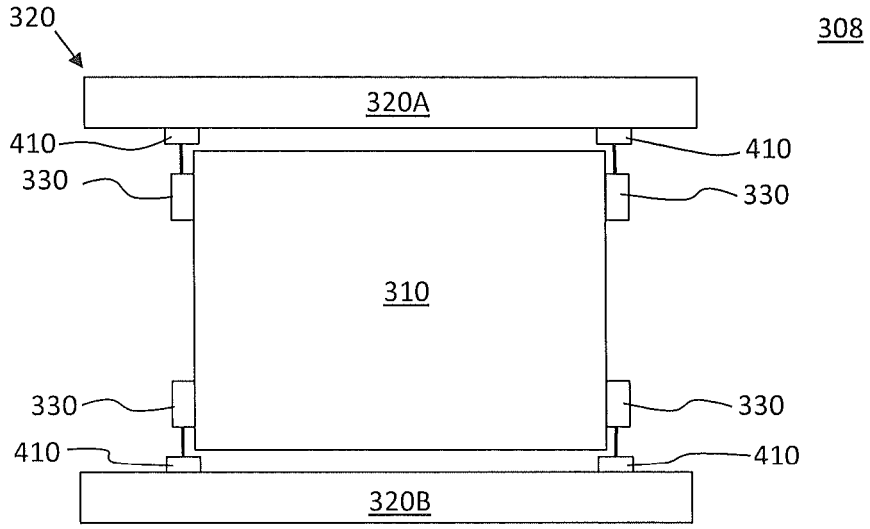
FIG. 18 shows a schematic view of a panel assembly.

FIG. 18 shows an exemplary embodiment of the panel assembly 308. Panel assembly 308 may include a base plate 410 adapted to engage the extendable connecting assembly 330 extending from the panel 310. Base plate 410 may be mountable to the frame 320.

Figure 19:
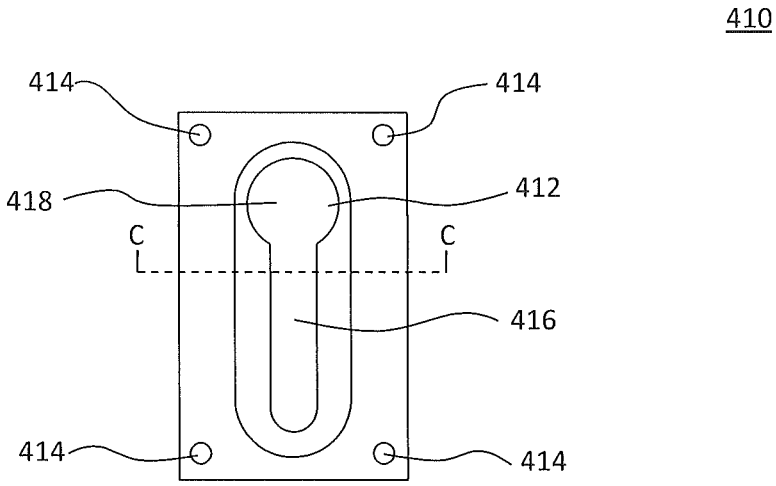
FIG. 19 shows a top view of a base plate.

FIG. 19 shows an exemplary embodiment of the base plate 410. Base plate 410 may include a receiving portion 412 adapted to receive the engaging end 156 (not shown in FIG. 19) of the extendable connecting assembly 330 (not shown in FIG. 19) when mounting the panel assembly 306 (not shown in FIG. 19) to the frame 320 (not shown in FIG. 19). Base plate 410 may include through holes 414 adapted to allow fasteners, e.g. bolts, therethrough for securing the base plate 410 to the frame 320.

Receiving portion 412 may include a slot 416 having a width and an opening 418 connected to the slot 416. Opening 418 may be wider than the width of the slot 416, such that the opening 418 may be adapted to receive the knob (not shown in FIG. 19) therethrough and the slot 416 is adapted to prevent the knob therethrough.

Figure 20:
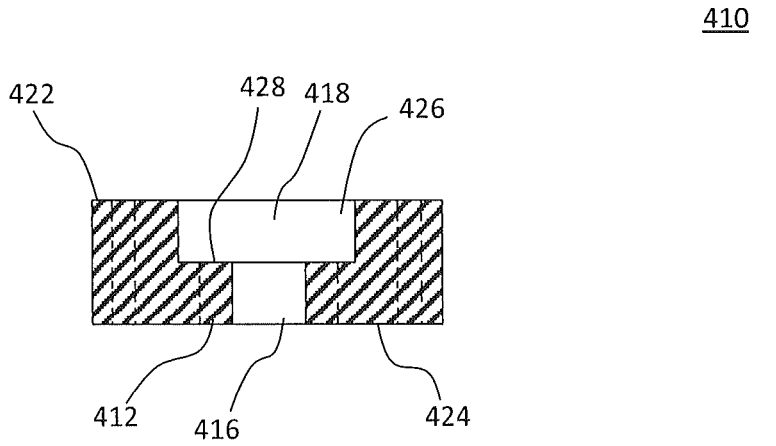
FIG. 20 shows a sectional view of the base plate in FIG. 19 along line C-C.

FIG. 20 shows a sectional view of the base plate 410 along line C-C in FIG. 19. Receiving portion 412 may have a first side 422 adapted to contact the frame 320 (not shown in FIG. 20) when the base plate 410 is mounted to the frame 320 and a second side 424 opposite the first side 422 such that the second side may be adapted to face the panel assembly 308 (not shown in FIG. 20) when the panel assembly 308 is mounted to the frame 320. Slot 416 and opening 418 extends from the first side 422 of the base plate 410 to the second side 424 of the base plate 410. A recess 426 may be formed on the first side 422 such that the base of the recess 426 may form a shoulder 428. Referring to FIG. 20, the shoulder 428 may surround the slot 416. As shown in FIG. 19, the slot 416 may be a straight slot. Referring to FIG. 20, the recess 426 may have a depth whereby the depth of the recess 426 may substantially be the diameter of the knob (not shown in FIG. 20) so that the knob may be within the recess 426 and against the shoulder 428 when the engaging end 356 of the connecting portion 340 of the extendable connecting assembly 330 engages the base plate 410.

Figure 21:
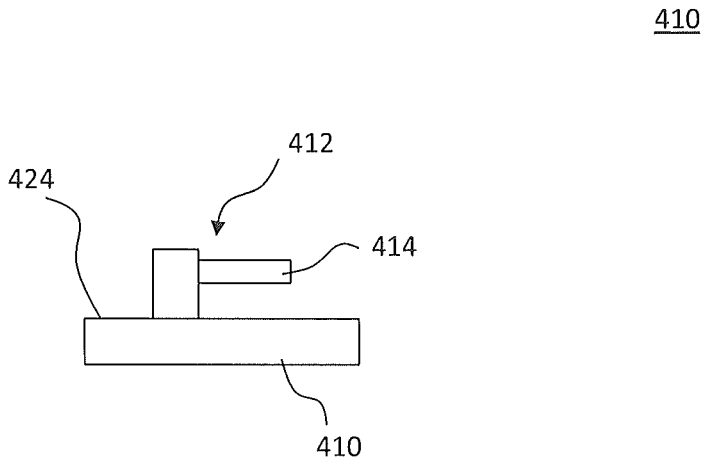
FIG. 21 shows a schematic view of a base plate.

FIG. 21 shows an elevation view of base plate 410. As shown in FIG. 21, the receiving portion 412 may include a hook 414 extending from the second side 424 of the base plate 410. Engaging end 356 (not shown in FIG. 21) of the expandable connecting assembly 330 may include a complementary loop adapted to engage the hook 414.

Figure 21A:
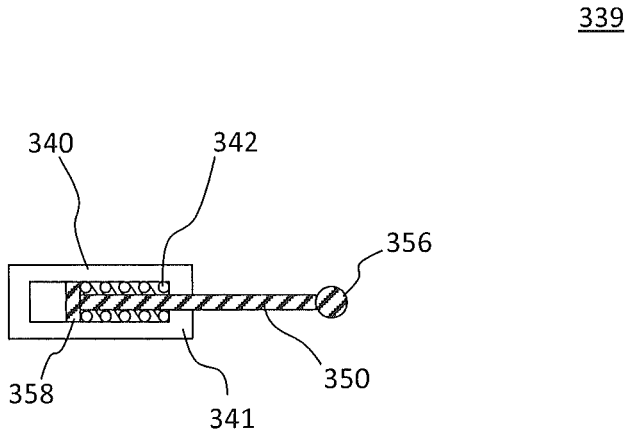
FIG. 21A shows a sectional view of an extendable connecting assembly.

FIG. 21A shows a sectional view of an extendable connecting assembly 339. Controlling portion 340 may include a resilient portion 342 to resiliently prevent the extension of the connecting portion 350. Resilient portion 342 may include a spring engaging the connecting portion 350 such that when the connecting portion 350 is extended from the controlling portion 340, the spring is compressed to decelerate the extension of the connecting portion 350 from the controlling portion 340. Connecting portion 350 may include the engaging end 356 adapted to engage the frame 320 (not shown in FIG. 21A) and a stopping end 358 opposite the engaging end 356, the stopping end 358 may be adapted to press against one end of the resilient portion 342 whereby resilient portion 342 may be pressed against the stopping end 358 of the connecting portion 350 at the one end and against a casing 341 of the controlling portion 340 at the other end of the resilient portion 342.

Figure 22:
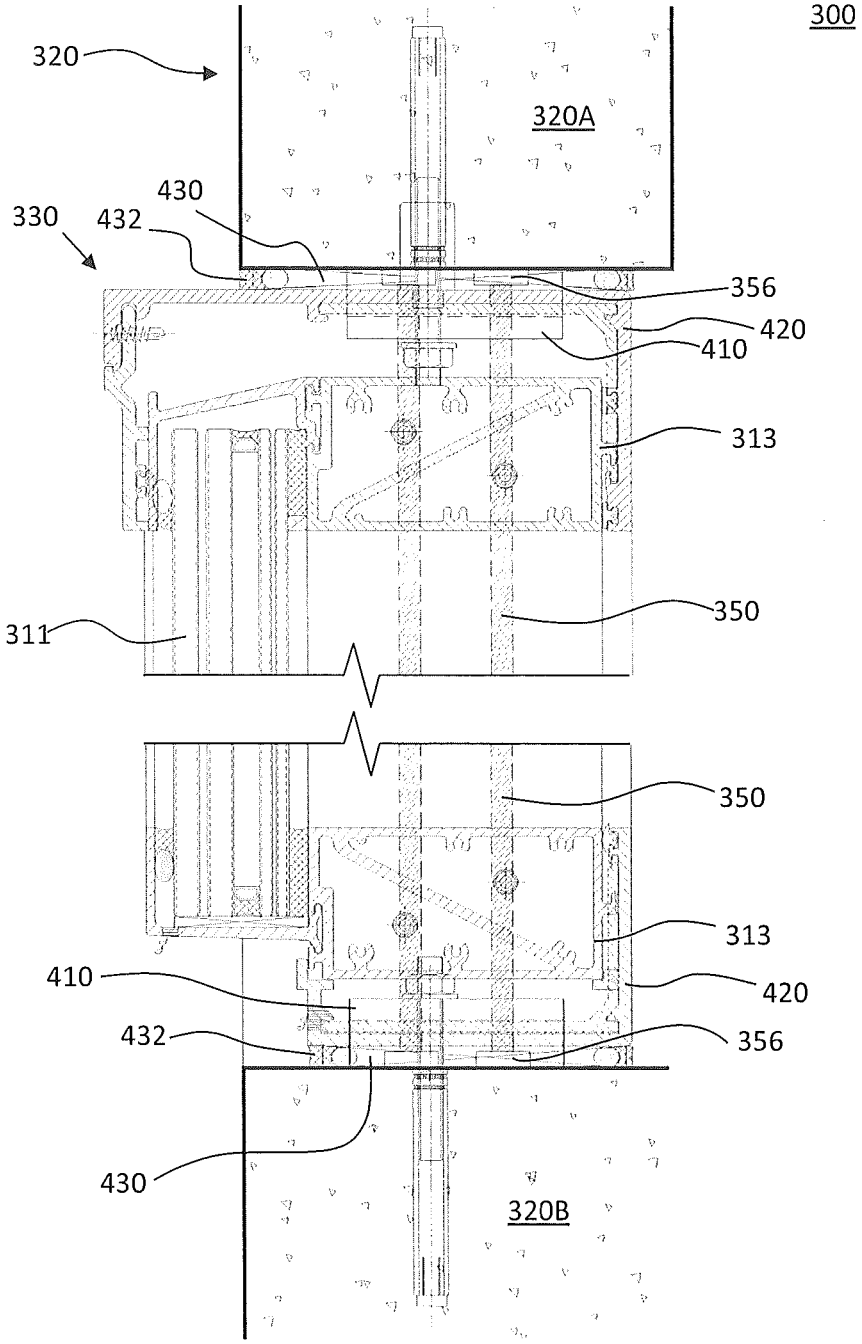
FIG. 22 shows a sectional view of a panel assembly mounted to a frame.

FIG. 22 shows another sectional view perpendicular to the sectional view of the panel assembly 300 in FIG. 14. FIG. 22 is a sectional view along a plane through the front side and rear side of the panel 330. Panel assembly 300 has been truncated to fit the panel assembly 300 within a page. FIG. 22 shows the panel 330 being mounted to the frame 320. Base plate 410 may be mounted to the frame 320. Panel 330 may be mounted to the base plate 410. Engaging end 356 of the connecting portion 350 may be engaged to the base plate 410.

A subframe 420 may be mounted to the frame 320 to receive the panel assembly 300. Subframe 420 may be separated from the frame 320 by a packer 430. As the frame 320 may have an undulating surface against the panel 330, the packer 430 may be used to fill in the gap between the frame 320 and the panel 330. A sealant 432 may be used to cover the gap between the panel 330 and the frame 320. Base plate 410 may extend through the subframe 420 to provide access for the mounting of the panel assembly 300. Panel assembly 300 may be mounted onto the subframe 420 before engaging the connecting portion 350 to the base plate 410. Window frame 313 may be mounted to the subframe 420 to position the panel assembly 300 to the frame 320. Panel assembly 300 may rest onto the bottom portion of the frame 320B. Engaging ends 356 of the extendable connecting assembly (not shown in FIG. 22) may engage the base plates 410 mounted to the top portion 320A and the bottom portion 320B of the frame 320. Knobs at the engaging ends 356 may be inserted into the opening 418 (not shown in FIG. 22) of the base plate 410 and glide along the slot 416 of the base plate 410 to secure the connecting portion 350 to the base plate 410.

Figure 23:
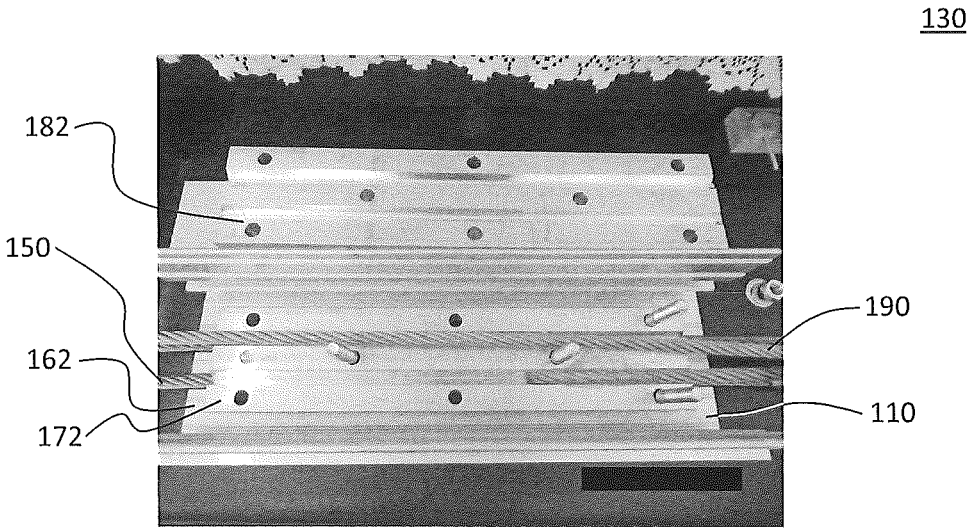
FIG. 23 shows a top view of an unassembled extendable connecting assembly.

FIG. 23 shows a top view of an unassembled extendable connecting assembly 130 having the first plate 162 being the part of the panel 110, the second plate 172 and the third plate 182. Connecting portion 150 and the another connecting portion 190 may be disposed between the first plate 162 and the second plate 172 and between the second plate 172 and the third plate 182 respectively.

Figure 24:
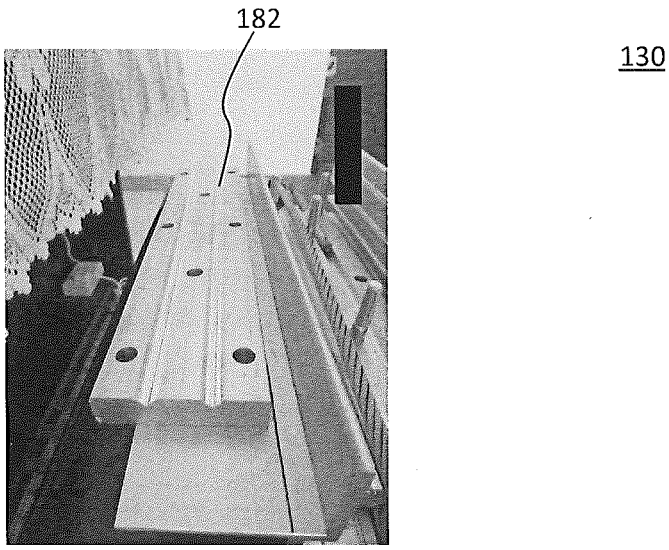
FIG. 24 shows a front perspective view of a plate.

FIG. 24 shows a frontal perspective view of the third plate 182 of the extendable connecting assembly 130.

Figure 25:
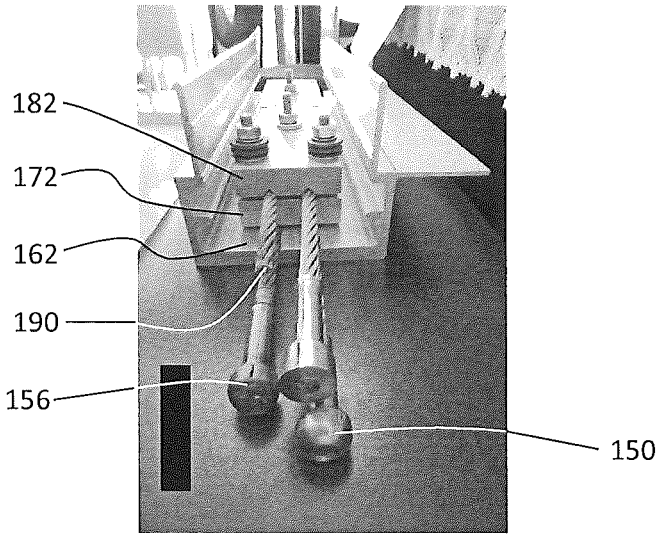
FIG. 25 shows a front perspective view of an extendable connecting assembly.

FIG. 25 shows a frontal perspective view of the extendable connecting assembly 130. As shown, the first plate 162 is formed as part of the panel 110. Connecting portion 150 and the another connecting portion 190 may be clamped between the first plate 162 and the second plate 172 and between the second plate 172 and the third plate 182 respectively.

Figure 26:
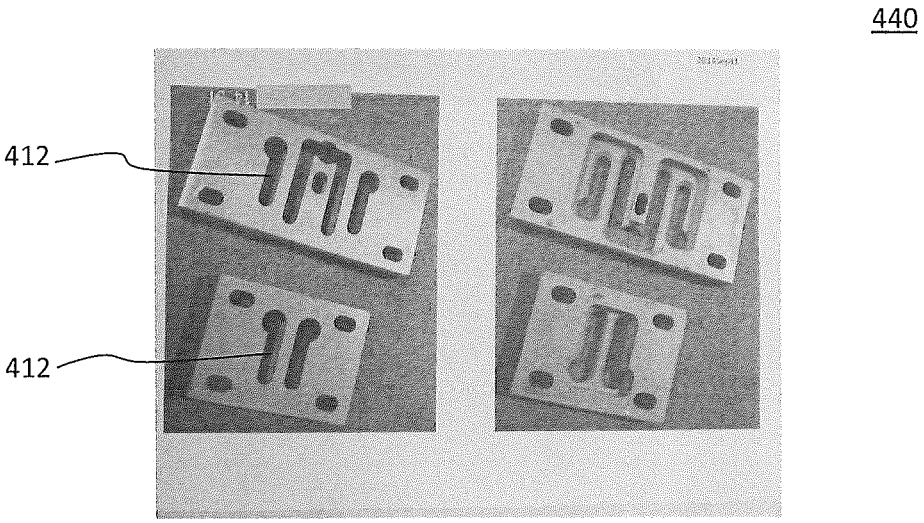
FIG. 26 shows a front view and a rear view of two base plates.

FIG. 26 shows an exemplary embodiment of the base plate 440. Base plate 440 may include a plurality of receiving portions 412. Plurality of receiving portions 412 may include at least one of a U-shaped slot, or a straight slot.

Figure 27:
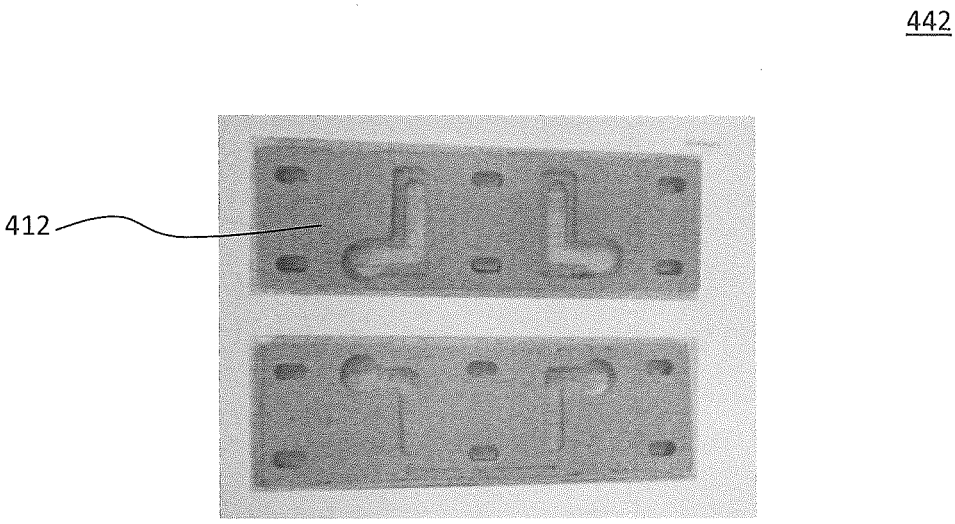
FIG. 27 shows a front view and a rear view of a base plate.

FIG. 27 shows an exemplary embodiment of the base plate 442. Base plate 442 may include a receiving portion 412 having an L-shaped slot.

The invention claimed is:

1. A panel assembly adapted to absorb a blast effect, the panel assembly comprising, a panel adapted to be displaceably mounted to a frame;

an extendable connecting assembly extending from the panel and adapted to be connectable to the frame so as to mount the panel to the frame, the extendable connecting assembly is adapted to extend in a longitudinal direction and comprises, a controlling portion connected to the panel, a connecting portion adapted to be connectable to the frame, the connecting portion guidable through the controlling portion by displacing the connecting portion through the controlling portion to allow the connecting portion to glide through the controlling portion thereby extending the extendable connecting assembly, wherein the controlling portion comprises a clamp adapted to clamp the connecting portion to control gliding of the connecting portion through the controlling portion, wherein the gliding of the connecting portion due to the blast effect on the panel is decelerated due to friction generated by clamping of the connecting portion.

2. The panel assembly of claim 1, wherein the clamp comprises a first plate having an upper engaging surface and a second plate having a lower engaging surface, the upper engaging surface of the first plate is adapted to face the lower engaging surface of the second plate, the connecting portion being clamped between the first plate and the second plate.

3. The panel assembly of claim 2, wherein the first plate comprises a gripping portion on the upper engaging surface, the gripping portion adapted to grip the connecting portion.

4. The panel assembly of claim 3, wherein the gripping portion of the first plate comprises a groove extending along the upper engaging surface of the first plate and wherein the connecting portion is disposed within the groove of the first plate.

5. The panel assembly of claim 2, wherein the second plate comprises a gripping portion on the lower engaging surface of the second plate, the gripping portion adapted to grip the connecting portion.

6. The panel assembly of claim 5, wherein the gripping portion of the second plate comprises a groove extending along the lower engaging surface of the second plate and wherein the connecting portion is disposed within the groove of the second plate.

7. The panel assembly of claim 2, wherein the extendable connecting assembly further comprises, a third plate having a lower engaging surface facing an upper engaging surface of the second plate, wherein the upper engaging surface of the second plate is opposite of the lower engaging surface of the second plate; and another connecting portion clamped between the second plate and the third plate, and between the upper engaging surface of the second plate and the lower engaging surface of the third plate.

8. The panel assembly of claim 1, wherein the connecting portion extends through the controlling portion.

9. The panel assembly of claim 1, wherein the extendable connecting assembly extends from one side of the panel.

10. The panel assembly of claim 9, wherein the panel assembly comprises another extendable connecting assembly extending from another side of the panel opposite the one side.

11. The panel assembly of claim 1, wherein the panel assembly comprises at least two of the extendable connecting assemblies extending from one side of the panel and at least two of the extendable connecting assemblies extending from another side of the panel opposite the one side.

12. The panel assembly of claim 11, wherein the connecting portions of the at least two extendable connecting assemblies are connected to each other such that the connecting portions form a single continuous connecting portion and extend through the controlling portions of the at least two extendable connecting assemblies.

13. The panel assembly of claim 11, further comprising another extendable connecting assembly extending from the panel and disposed between the at least two extendable connecting assemblies, wherein the connecting portions of each of the at least two extendable connecting assemblies and the another extendable connecting assembly form a single continuous connecting portion through each of the controlling portions of the at least two extendable connecting assemblies and the another extendable connecting assemblies.

14. The panel assembly of claim 1, wherein the connecting portion includes a cable.

15. The panel assembly of claim 1, wherein the connecting portion comprises an enlarged end at an end of the connecting portion.

16. The panel assembly of claim 1, wherein the connecting portion comprises an engaging end adapted to engage the frame.

17. The panel assembly of claim 1, further comprising a base plate adapted to engage the extendable connecting assembly, the base plate being mountable to the frame.

18. The panel assembly of claim 17, wherein the base plate comprises a receiving portion adapted to receive the engaging end of the extendable connecting assembly when mounting the panel assembly to the frame.

19. The panel assembly of claim 18, wherein the engaging end comprises a knob and the receiving portion comprises a slot having a width and an opening connected to the slot, the opening being wider than the width of the slot, wherein the opening is adapted to receive the knob therethrough and the slot is adapted to prevent the knob therethrough.

* * * * *